US008646654B2

(12) United States Patent
Miller

(10) Patent No.: US 8,646,654 B2
(45) Date of Patent: Feb. 11, 2014

(54) CARTON WITH DISPENSER

(75) Inventor: Charles A. Miller, Williamsburg, OH (US)

(73) Assignee: The C.W. Zumbiel Company, Hebron, KY (US)

( * ) Notice: Subject to any disclaimer, the term of this patent is extended or adjusted under 35 U.S.C. 154(b) by 0 days.

(21) Appl. No.: 13/399,359

(22) Filed: Feb. 17, 2012

(65) Prior Publication Data

US 2012/0145775 A1 Jun. 14, 2012

Related U.S. Application Data

(63) Continuation of application No. 12/766,242, filed on Apr. 23, 2010, now Pat. No. 8,118,212, which is a continuation of application No. 10/680,364, filed on Oct. 7, 2003, now abandoned.

(60) Provisional application No. 60/424,616, filed on Nov. 7, 2002, provisional application No. 60/496,080, filed on Aug. 18, 2003.

(51) Int. Cl.
*B65G 59/00* (2006.01)
*B65H 3/30* (2006.01)

(52) U.S. Cl.
USPC ..... 221/305; 221/205; 221/122.1; 221/122; 206/427; 206/193; 206/141; 206/429; 206/44.21; 206/45.25; 206/607; 206/494; 206/45.21; 206/428; 229/122; 229/243

(58) Field of Classification Search
CPC ..... B65G 59/00; B65H 3/30
USPC ..... 206/427, 193, 141, 429, 44.12, 607, 206/494, 45.25, 44.21, 4, 5.21, 528; 221/122, 205, 305, 122.1
See application file for complete search history.

(56) References Cited

U.S. PATENT DOCUMENTS 902,347 A 10/1908 Tillinghast
1,541,143 A 6/1925 Hoile (Continued)

FOREIGN PATENT DOCUMENTS

CA 874828 A 7/1971
CA 2246020 A1 2/2000

(Continued)

OTHER PUBLICATIONS

European Patent Office; Supplemental Search Report in European Patent Application No. 03773316.9 dated Jan. 15, 2009, 4 pages.

(Continued)

*Primary Examiner* — Gene O. Crawford
*Assistant Examiner* — Rakesh Kumar
(74) *Attorney, Agent, or Firm* — Wood, Herron & Evans, LLP

(57) ABSTRACT

A package includes an article group formed of cylindrical articles disposed on their sides in a side-by-side parallel fashion, and a carton disposed around the group. The carton includes a top wall, opposed side walls, end walls and an article dispenser. The side walls are disposed alongside the ends of the articles while one end wall is disposed adjacent to the side wall of an endmost article. The dispenser is formed from the end and top walls and includes at least one retaining panel to hold all the articles in the carton until removed by the user.

18 Claims, 6 Drawing Sheets

(56) References Cited

U.S. PATENT DOCUMENTS 1,609,186 A 11/1926 Peruzzi
1,853,219 A 4/1932 Newton
1,925,102 A 9/1933 Levkoff
2,026,477 A 12/1935 Lescher
2,067,749 A 1/1937 Zimmerman et al.
2,115,673 A * 4/1938 Stompe ..... 248/612
2,278,793 A 4/1942 Myers
2,316,796 A 4/1943 Lichter
2,448,819 A 9/1948 Mitchell
2,619,226 A 11/1952 Adams
2,718,301 A 9/1955 Palmer
2,723,027 A 11/1955 Guyer
2,754,047 A 7/1956 Schmidt et al.
2,842,304 A 7/1958 Ringler
2,844,298 A 7/1958 Tamarin
2,868,431 A 1/1959 Painter
2,930,516 A 3/1960 Fowle et al.
2,975,891 A 3/1961 Stone
2,990,097 A 6/1961 Thompson
3,002,651 A 10/1961 Gauld
3,018,031 A 1/1962 Ahlbor et al.
3,178,242 A 4/1965 Ellis
3,228,582 A 1/1966 Osberg
3,263,861 A 8/1966 Carr
3,265,283 A 8/1966 Farquhar
RE26,083 E 9/1966 Forrer
3,270,941 A 9/1966 Barnes
3,300,115 A 1/1967 Schauer
3,332,594 A 7/1967 Capua
3,356,279 A 12/1967 Root
3,416,719 A 12/1968 Pilger
3,517,858 A 6/1970 Farquhar
3,540,581 A 11/1970 Koolnis
3,599,858 A 8/1971 Samsing
3,669,251 A 6/1972 Phillips, Jr.
3,696,990 A 10/1972 Dewhurst
3,765,327 A 10/1973 Aronson et al.
3,765,527 A 10/1973 Vargo
3,784,022 A 1/1974 Beesley, Jr.
3,894,681 A 7/1975 Arneson et al.
3,913,739 A 10/1975 Hennessey
3,942,631 A 3/1976 Sutherland et al.
3,952,872 A 4/1976 Consiglio, Jr.
4,000,811 A 1/1977 Hardison et al.
D243,508 S 3/1977 Killy
4,030,596 A 6/1977 Snyder et al.
D252,259 S 7/1979 Rinehart
4,214,660 A 7/1980 Hunt, Jr.
4,216,861 A 8/1980 Oliff
4,222,485 A 9/1980 Focke
4,252,236 A 2/1981 Roccaforte
D263,204 S 3/1982 Dutcher
4,325,482 A 4/1982 Feeser
4,331,289 A 5/1982 Killy
4,340,170 A 7/1982 Montealegre
4,364,509 A 12/1982 Holley, Jr. et al.
4,375,258 A 3/1983 Crayne et al.
4,378,877 A 4/1983 Botterman et al.
D269,068 S 5/1983 Mann, Sr. et al.
D270,041 S 8/1983 Vestal
4,396,143 A 8/1983 Killy
4,405,078 A 9/1983 Dutcher et al.
4,416,410 A 11/1983 Herrmann
4,417,655 A 11/1983 Forbes, Jr.
4,417,661 A 11/1983 Roccaforte
4,466,536 A 8/1984 Zeitel
4,498,581 A 2/1985 Dutcher
4,558,816 A 12/1985 Wood
4,560,062 A 12/1985 Valiulis
4,577,799 A 3/1986 Oliff
4,582,199 A 4/1986 Schuster
4,588,084 A 5/1986 Holley, Jr.
4,605,128 A 8/1986 Rieke
D286,987 S 12/1986 Golan et al.
4,726,471 A 2/1988 Whately et al.
4,785,991 A 11/1988 Schuster
4,805,800 A 2/1989 Nocek et al.
4,817,866 A 4/1989 Wonnacott
D303,090 S 8/1989 Armor et al.
4,860,944 A 8/1989 Wonnacott
4,919,266 A 4/1990 McIntosh, Jr. et al.
4,966,324 A 10/1990 Steel
4,972,991 A 11/1990 Schuster
4,974,771 A 12/1990 Lavery
4,981,253 A 1/1991 Quaintance
4,982,845 A 1/1991 Prascak et al.
4,989,778 A 2/1991 Saulas
5,002,186 A 3/1991 Cooper
5,031,825 A 7/1991 Romagnoli
D321,134 S 10/1991 Toinet
5,067,615 A 11/1991 Davitian
5,072,876 A 12/1991 Wilson
5,101,642 A 4/1992 Alexandrov
5,106,014 A 4/1992 Miller
5,123,589 A 6/1992 Cote
5,137,211 A 8/1992 Summer et al.
5,143,252 A 9/1992 Shi
5,170,934 A 12/1992 Lemoine
D332,915 S 2/1993 Hoell et al.
5,249,681 A 10/1993 Miller
5,265,798 A 11/1993 DeMaio et al.
5,277,360 A 1/1994 DeMott
5,279,440 A 1/1994 Fougeres et al.
5,284,292 A 2/1994 Johnson
5,289,943 A 3/1994 Powell
5,292,059 A 3/1994 Oliff
5,297,725 A 3/1994 Sutherland
5,348,219 A * 9/1994 Brintazzoli ..... 229/131.1
5,368,194 A 11/1994 Oliff et al.
5,372,299 A 12/1994 Edgerton, Jr. et al.
5,385,234 A 1/1995 Stout et al.
5,425,474 A 6/1995 Dalea et al.
5,427,242 A 6/1995 Oliff et al.
5,437,407 A 8/1995 Kim
5,439,168 A 8/1995 Kim
5,465,831 A 11/1995 Smith
5,482,185 A 1/1996 McNaughton
5,482,203 A 1/1996 Stout
5,505,372 A * 4/1996 Edson et al. ..... 229/121
5,518,111 A 5/1996 Stout
5,577,612 A * 11/1996 Chesson et al. ..... 206/494
5,597,114 A 1/1997 Kramedjian et al.
5,622,309 A * 4/1997 Matsuda et al. ..... 229/243
D379,759 S 6/1997 Mulry
5,682,984 A 11/1997 Hoell et al.
5,690,213 A 11/1997 Matsumura
5,699,957 A 12/1997 Blin et al.
5,722,584 A 3/1998 Fujiwara
5,775,574 A 7/1998 Whitnell
5,788,117 A 8/1998 Zimmanck
5,826,783 A 10/1998 Stout
5,833,118 A 11/1998 Weiss
5,857,614 A 1/1999 Walsh
5,873,515 A 2/1999 Dunn et al.
5,878,947 A 3/1999 Hoy et al.
5,881,884 A 3/1999 Podosek
5,921,398 A 7/1999 Carroll
5,924,559 A * 7/1999 Carrel et al. ..... 206/45.21
5,996,797 A 12/1999 Flaig
6,019,276 A 2/2000 Auclair
6,105,854 A 8/2000 Spivey et al.
6,105,856 A 8/2000 Kakiuchi
6,155,480 A 12/2000 Botsford et al.
D436,859 S 1/2001 Botsford et al.
6,170,741 B1 1/2001 Skolik et al.
6,176,419 B1 1/2001 Holley, Jr.
6,209,786 B1 4/2001 Yelton et al.
6,244,436 B1 6/2001 Boriani et al.
6,253,930 B1 7/2001 Freidus et al.
6,273,330 B1 8/2001 Oliff et al.
6,283,293 B1 9/2001 Lingamfelter
D454,784 S 3/2002 Oram
6,386,369 B2 5/2002 Yuhas et al.
6,386,438 B1 5/2002 Walsh et al.

(56) References Cited

U.S. PATENT DOCUMENTS

| | | | | |
|---|---|---|---|---|
| 6,390,290 | B1 | 5/2002 | Focke et al. | |
| 6,435,351 | B1 | 8/2002 | Gibb | |
| 6,457,580 | B1 | 10/2002 | Focke et al. | |
| 6,474,469 | B1 | 11/2002 | Luton et al. | |
| 6,478,219 | B1 | 11/2002 | Holley, Jr. | |
| 6,484,903 | B2 | 11/2002 | Spivey et al. | |
| 6,550,615 | B2 | 4/2003 | Lingamfelter | |
| 6,578,736 | B2 | 6/2003 | Spivey | |
| 6,631,803 | B2 | 10/2003 | Rhodes et al. | |
| 6,715,639 | B2 | 4/2004 | Spivey | |
| 6,918,487 | B2 * | 7/2005 | Harrelson | 206/427 |
| 6,929,172 | B2 | 8/2005 | Bates et al. | |
| 7,000,824 | B2 | 2/2006 | Saulas | |
| 7,134,551 | B2 | 11/2006 | Harrelson | |
| 7,237,674 | B2 | 7/2007 | Auclair | |
| 7,467,713 | B2 | 12/2008 | Harrelson | |
| 7,614,497 | B2 | 11/2009 | Spivey, Sr. | |
| 7,648,060 | B2 * | 1/2010 | DeBusk | 229/122 |
| 7,780,003 | B2 | 8/2010 | Harrelson | |
| 8,118,212 | B2 * | 2/2012 | Miller | 229/122 |
| 2002/0029991 | A1 | 3/2002 | Lingamfelter | |
| 2002/0070139 | A1 | 6/2002 | Bates | |
| 2002/0088820 | A1 | 7/2002 | Spivey | |
| 2002/0088821 | A1 | 7/2002 | Spivey et al. | |
| 2002/0185499 | A1 | 12/2002 | Harrelson et al. | |
| 2002/0185527 | A1 | 12/2002 | Bates | |
| 2003/0141353 | A1 * | 7/2003 | Wilson | 229/103.2 |
| 2003/0150759 | A1 * | 8/2003 | White, Jr. | 206/427 |
| 2003/0192907 | A1 * | 10/2003 | Bates | 221/305 |
| 2004/0089671 | A1 | 5/2004 | Miller | |
| 2004/0155098 | A1 * | 8/2004 | Harrelson | 229/122 |
| 2005/0085364 | A1 * | 4/2005 | Spivey, Sr. | 493/68 |
| 2007/0017966 | A1 | 1/2007 | DeBusk et al. | |
| 2007/0062834 | A1 * | 3/2007 | Harrelson | 206/427 |
| 2010/0187144 | A1 * | 7/2010 | Harrelson | 206/427 |

FOREIGN PATENT DOCUMENTS

| | | | |
|---|---|---|---|
| DE | 2323589 | A1 | 11/1974 |
| DE | 7510538 | U | 8/1975 |
| DE | 7606493 | U1 | 6/1976 |
| DE | 2933022 | A1 | 2/1980 |
| DE | 3007769 | A1 | 9/1981 |
| DE | 8135176 | U1 | 5/1982 |
| DE | 8514718 | U1 | 6/1985 |
| DE | 8629664 | U1 | 5/1987 |
| DE | 3612594 | A1 | 10/1987 |
| DE | 4023043 | A1 | 12/1991 |
| DE | 9412885 | U1 | 10/1994 |
| DE | 9413813 | U1 | 10/1994 |
| DE | 29519931 | U1 | 2/1996 |
| DE | 29602010 | U1 | 3/1996 |
| DE | 19802800 | A1 | 7/1999 |
| DE | 29909008 | U1 | 9/1999 |
| DE | 29913585 | U1 | 10/1999 |
| DE | 69421620 | T2 | 4/2000 |
| EP | 0235852 | A2 | 9/1987 |
| EP | 0323596 | A1 | 7/1989 |
| EP | 0342088 | A1 | 11/1989 |
| EP | 0475147 | A1 | 3/1992 |
| EP | 0659143 | A1 | 6/1995 |
| EP | 0752370 | A2 | 1/1997 |
| EP | 0849189 | A1 | 6/1998 |
| EP | 0936995 | A1 | 8/1999 |
| EP | 1038783 | A1 | 9/2000 |
| EP | 1060998 | A2 | 12/2000 |
| FR | 2683207 | A1 | 5/1993 |
| FR | 2761342 | A1 * | 10/1998 |
| GB | 2184999 | A | 7/1987 |
| GB | 2186550 | A | 8/1987 |
| JP | 79721 | | 2/1994 |
| WO | 8809750 | A1 | 12/1988 |
| WO | 9525668 | A1 | 9/1995 |
| WO | 9629260 | A1 | 9/1996 |
| WO | 96/36538 | A2 | 11/1996 |
| WO | 9721607 | A1 | 6/1997 |
| WO | 9831593 | A1 | 7/1998 |
| WO | 9964301 | A1 | 12/1999 |
| WO | 0023334 | A1 | 4/2000 |
| WO | 0071428 | A1 | 11/2000 |
| WO | 0128871 | A1 | 4/2001 |
| WO | 0204302 | A1 | 1/2002 |
| WO | 02/30785 | A1 | 4/2002 |
| WO | 02085739 | A1 | 10/2002 |
| WO | 2005/037663 | A1 | 4/2005 |
| WO | 2005051777 | A2 | 6/2005 |
| WO | 2005051782 | A1 | 6/2005 |

OTHER PUBLICATIONS

International Bottler & Packer; "Hot Hit With Consumers" published Nov. 2001.

Wall Street Journal; "Coke Bottler Tests a Slimmer Soda Package" published Aug. 10, 2001.

Beverage World; "Passing the Torch" published Oct. 2002.

Coca Cola Fridge Mate; "Revise Woolworth's Advertisement"; WCA 4000/N1A.

* cited by examiner

CARTON WITH DISPENSER

CROSS-REFERENCE TO RELATED APPLICATIONS

This is a continuation of U.S. patent application Ser. No. 12/766,242 filed Apr. 23, 2010 and issued as U.S. Pat. No. 8,118,212 on Feb. 21, 2012, which was a continuation of U.S. patent application Ser. No. 10/680,364 filed Oct. 7, 2003, which claims the benefit of U.S. Provisional Patent Application Ser. No. 60/424,616, filed Nov. 7, 2002 and U.S. Provisional Patent Application Ser. No. 60/496,080, filed Aug. 18, 2003, each of the disclosures of which is hereby incorporated by reference in its entirety.

BACKGROUND OF THE INVENTION

The invention relates to cartons, and more particularly, to a carton for multiple articles such as beverage cans in which the carton has a dispenser for controlled removal of individual articles.

Cartons for encasing multiple articles are useful for enabling consumers to obtain and transport a desired quantity of individual articles such as soft drinks or other beverages. A consumer frequently desires to remove one article at a time from the multiple-pack carton. Thus, a carton with a dispenser that facilitates the removal of a single article from the carton at a time is desirable.

When the articles contained in the carton are cylindrical, and are disposed in the carton upon their sides (i.e., with the longitudinal axis of the cylinder being generally horizontal), it is important that the articles be constrained such that the remaining articles do not roll out of the dispenser when one article is removed. Another important feature is that the dispenser provides easy access to the articles. Additionally, when removing individual articles from such a carton, the user should be able to easily determine how many articles remain in the carton. Thus, a carton with a dispenser that constrains remaining articles so that they do not undesirably roll from or otherwise exit the carton when one article is removed is also desirable.

Cartons and dispensers which are aimed at satisfying at least some of these objectives are disclosed in U.S. Pat. No. 6,578,736; U.S. Patent Application Serial Nos. US 2002/0070139; US 2002/0088820; and US 2002/0088821, each of which is hereby incorporated by reference. Nevertheless, the cartons and associated dispensers disclosed in each of those patent applications each suffer from significant drawbacks. Namely, when a user first opens each of those cartons via the dispenser, the upper, forward most article or beverage can tends to escape or roll uncontrolled from the carton through the dispenser being opened. Commonly, the user is concentrating his or her efforts and attention on properly opening the dispenser for future use without damaging or tearing the remainder of the carton. As a result, the upper and forward most article/can goes tumbling uncontrollably from the carton and toward the floor, the user's foot or some other unintended target. Typically the articles are cans filled with a carbonated beverage or the like. In addition to the potential injury or damage caused by the errant article, such bouncing and tumbling generates significant pressure within the can which causes a substantial spray and mess when the can is contemporaneously opened. Otherwise, the user must retrieve the errant can and swap it with another one in the carton. Nevertheless, it should be readily apparent that such dispensers present significant problems in actual use.

Another problem with known designs is that once the dispenser is opened, the user cannot easily and conveniently close the carton for any reason, such as transporting the carton and any remaining cans or articles therein.

Further still, consumer packaging of this type provides a valuable and significant merchandising opportunity for promotional items and advertising. The surfaces of the cartons are frequently used by manufacturers for highly graphic displays, advertising and/or theme promotions. Known dispensers often require the removal of a significant portion of the carton for the dispensing outlet. This significantly and detrimentally impacts the available and useful space on the carton for such displays, advertising and theme promotions.

SUMMARY OF THE INVENTION

These and other drawbacks in the prior art have been addressed and overcome with a carton and dispenser of this invention. A carton of this invention has a dispenser for articles which exposes the upper corner of the carton to reveal an endmost article for removal.

In a first embodiment of this invention, the carton includes serially and foldably connected bottom, side, top and side panels. Each of these panels also includes end flaps projecting from each end of the panel. An out board edge of one of the side panels includes a glue flap for joinder to the bottom panel. The corresponding end flaps on one end of the carton are folded and glued together to close the carton. The corresponding end flaps on the opposite end of the carton are folded together and include a dispenser according to the embodiments of this invention.

Such a dispenser includes a pair of slanted tear lines in the bottom end flap. A finger hole is formed at the juncture of the bottom panel, bottom end flap and slanted tear lines to commence opening the carton and dispenser. Each side end flap at the dispensing end of the carton includes a tear line which angularly projects from the side edge of the side end flap adjacent to the bottom end flap toward the fold line joining the side end flap to the side panel. The tear line then extends along the fold line joining the side end flap with the side panel to the intersection of the top panel and top end flap. The tear line then progresses along the juncture between the top panel and the side panel toward the handle formed in the top panel of the carton. The tear lines along the common edges of the top panel and each adjacent side panel extend at an angle into the top panel and terminate at a cut crease score or fold line which extends laterally across the top panel. The tear line forming the dispenser of this embodiment does not extend through either side panel or the top panel of the carton. The crease line across the top panel joining the corresponding tear lines is a fold line as opposed to an extension of the tear lines.

Once the carton is erected and filled, the user opens the dispenser by inserting a finger into the hole in the bottom panel adjacent the bottom end flap and pulling a middle portion of the bottom end flap and the center portions of the side end flaps upwardly tearing along the tear line through the bottom end flap and side end flaps. As the user continues to pull upwardly, the dispenser is torn along the tear lines adjacent the side panels and the top panel to the fold line in the top panel. In one variation of this embodiment, the top end flap is glued to the center portions of the side end flaps so that the entire dispensing structure is folded backwardly onto the top panel and a tongue flap formed from the center portion of the bottom end flap and the side end flaps is inserted into the handle opening in the top panel to securely and releasably retain the dispenser.

The cans do not fall from the carton once the dispenser is opened because a remaining portion of the side end flaps adjacent the side panel remain intact at the end of the carton to form retaining panels and hold the cans therein.

According to another embodiment of the invention, the carton includes an article dispenser for dispensing articles from the carton that includes two displaceable portions of the carton which are formed at the upper corner and detachably connected to the adjacent walls to be substantially detached or torn away from the carton to define an opening for exposing an endmost article for removal. The dispenser includes a retaining panel for inhibiting the endmost article from undesirably exiting the carton. The retaining panel extends upwardly from the bottom of the carton to inhibit cylindrical articles lying on their sides from undesirably rolling out from the carton.

In one embodiment of the carton, tear or zipper lines are disposed in the side walls and extend between the top wall and the end wall. The tear lines may be linear, segmented, curved concavely toward the end wall or of another configuration to expose greater or lesser areas of the opposite ends of the endmost article when the displaceable portion is detached.

Generally, the tear lines are disposed in the side walls and extend downwardly from the top wall to the end wall. A lowest point along each of the tear lines may be spaced above the lower edge of the respective side wall at a distance of about half of the diameter of the endmost article. The dispenser includes the retaining panel for inhibiting the lower, endmost article from undesirably exiting the carton. The retaining panel is formed from the end wall and extends upwardly to an elevation higher sufficient to keep the lower endmost article in the carton.

The carton also includes a hand-hole punch-through for grasping the displaceable portions. The punch-through may be defined by weakened lines formed in the top wall. The weakened lines may include a severance line and one or more fold lines which together form a grasping displaceable panel that is foldably connected to the other displaceable portion along the fold line.

Advantageously, the dispenser of this invention avoids problems of uncontrolled removal of the upper forward most article in the carton during removal and access to the dispenser. The first removable or displaceable portion of the dispenser in this embodiment is initially grasped by the user and pulled upwardly to expose the upper forward most article. Then, prior to removal of the second portion of the displaceable portion of the dispenser, the user removes the upper forward most article or can from the carton. Once that article/can is removed, the user then pulls opposing tabs of the second displaceable/removable portion outwardly. These tabs are located adjacent the intersection between the respective side wall and the top wall. Once those tabs are pulled outwardly, the tear or zipper line is torn by pulling the second displaceable portion of the carton downwardly and/or forwardly to thereby remove that portion of the carton and expose the open end for the dispenser. The bottom edge of the second removable/displaceable portion is spaced from the bottom end wall thereby leaving the retaining panel at the end wall for containing the remaining articles in the carton.

According to the carton, package and associated method for dispensing the packaged articles, this invention provides for a convenient and user friendly implementation of the dispenser and associated carton or package without the uncontrolled and/or inadvertent removal of the upper forward most article during the removal of the displaceable portion of the carton. Moreover, the dispenser does not require the removal of significant portions of the carton and can be reclosed if desired.

Other advantages and objects of the present invention will be apparent from the following description, the accompanying drawings, and the appended claims.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 4:
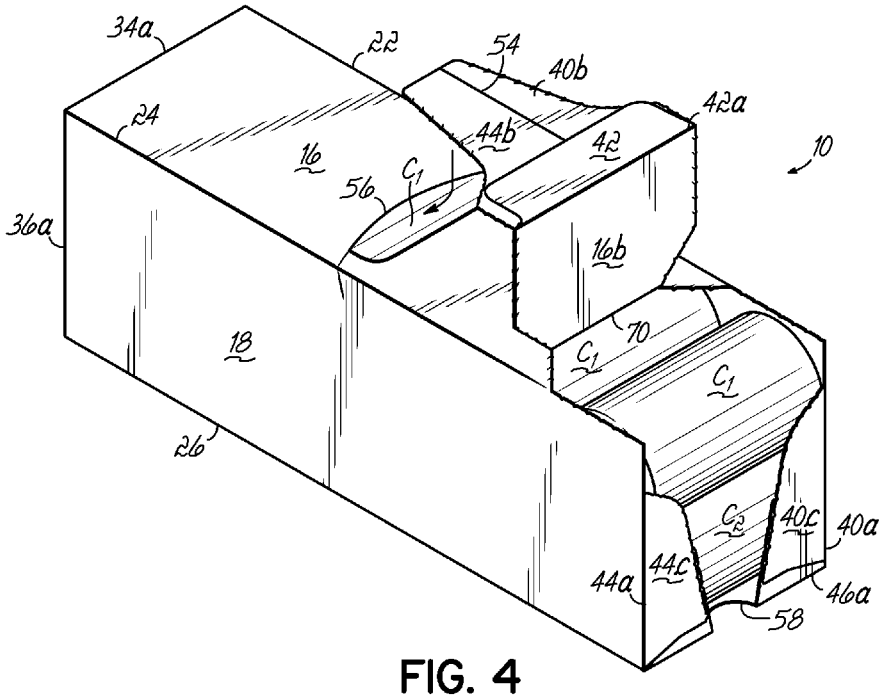
Figure 5:
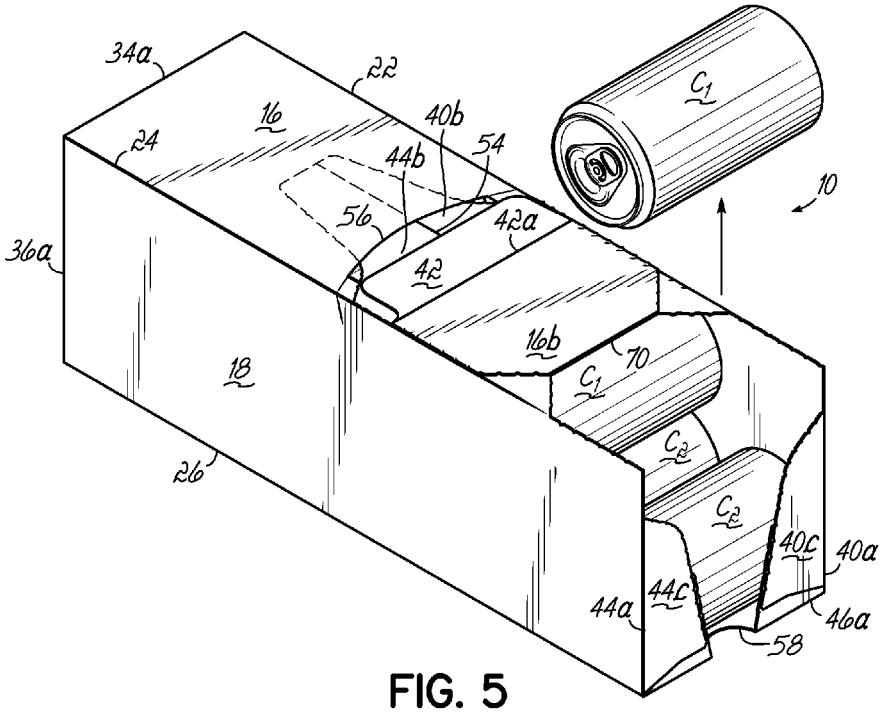
Figure 6:
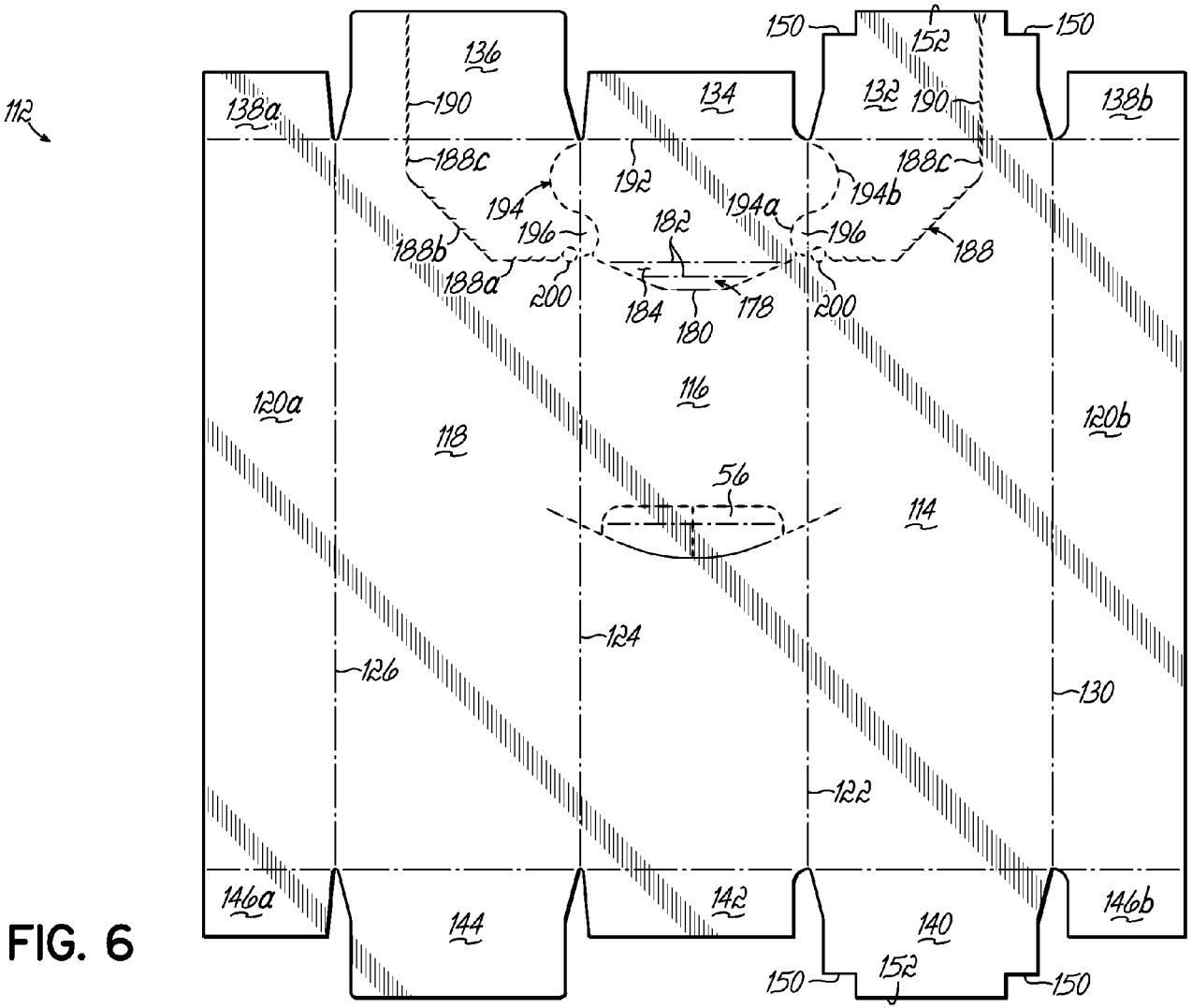
FIG. 6 is a plan view of a blank for forming a carton with a dispenser according to a further embodiment of this invention.
Figure 7:
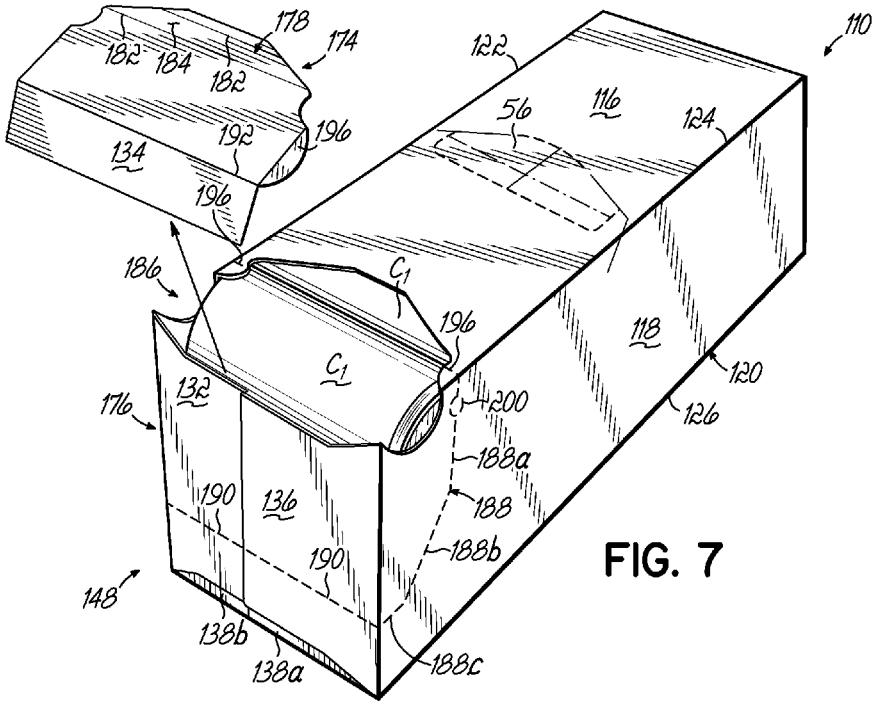
FIG. 7 is a perspective view of a carton constructed from the blank of FIG. 6 and showing a first removable portion of the carton detached for removal of one of the articles.
Figure 8:
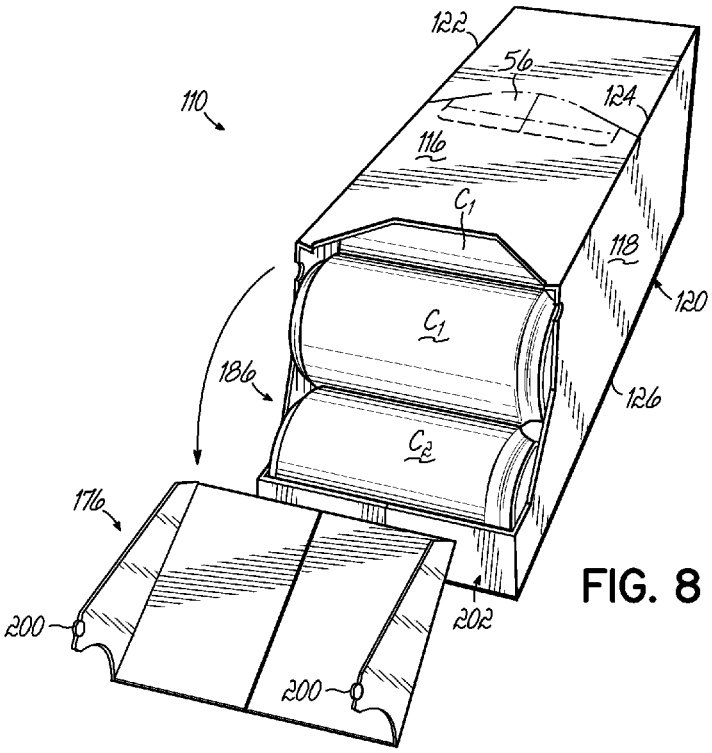
FIG. 8 is similar to FIG. 7 with a second removable portion of the carton detached to fully expose the dispenser.
Figure 9:
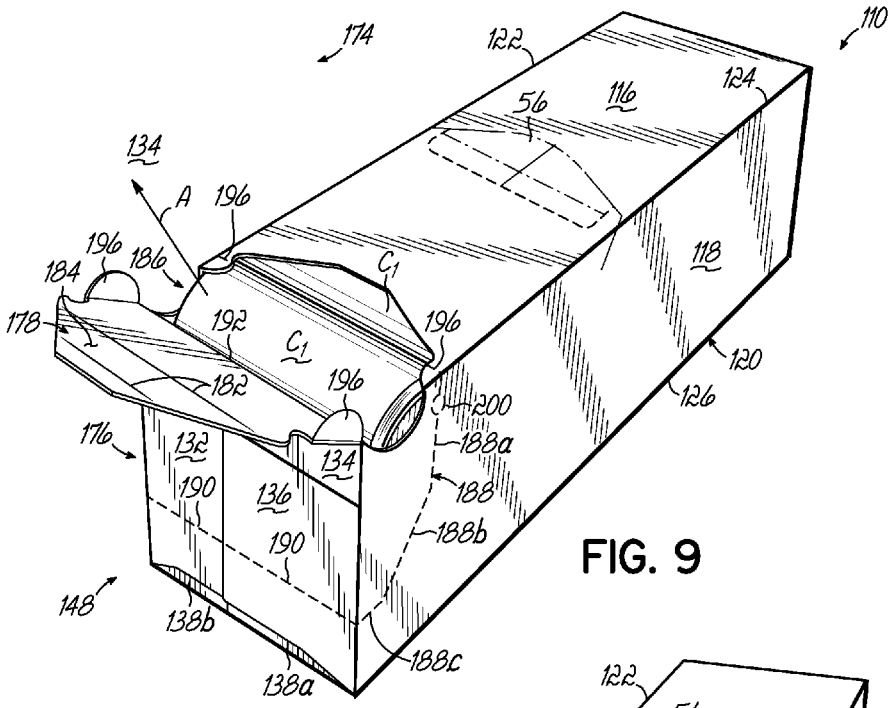
FIG. 9 is a perspective view of an alternate embodiment of a carton of this invention.
Figure 10:
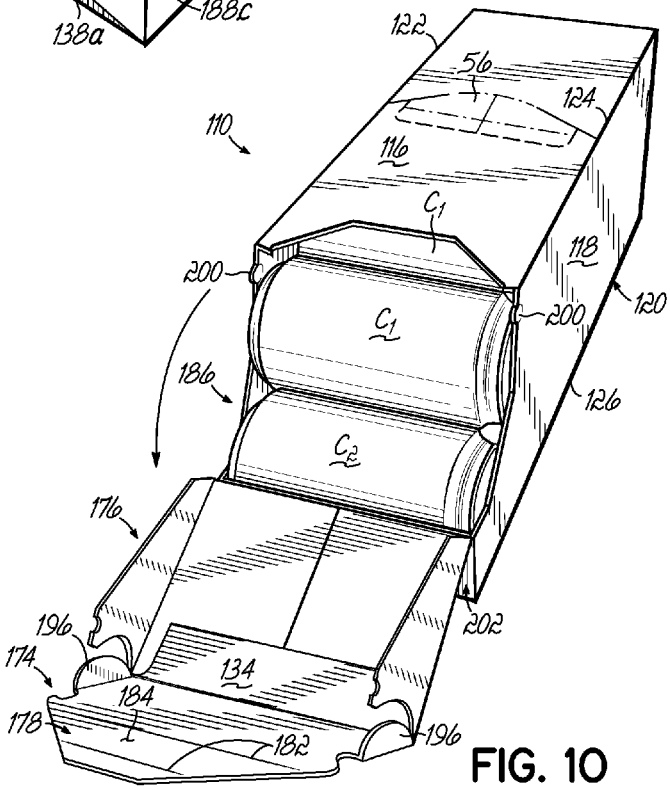
FIG. 10 is similar to FIG. 9 with the removable portions of the carton detached.

FIGS. 1 to 5 illustrate a first embodiment of this invention, FIGS. 6 to 8 illustrate a second embodiment and FIGS. 9 to 10 illustrate a third embodiment. Throughout these drawings, the same or similar reference numerals are used to denote the same or similar features of the invention.

Figure 1:
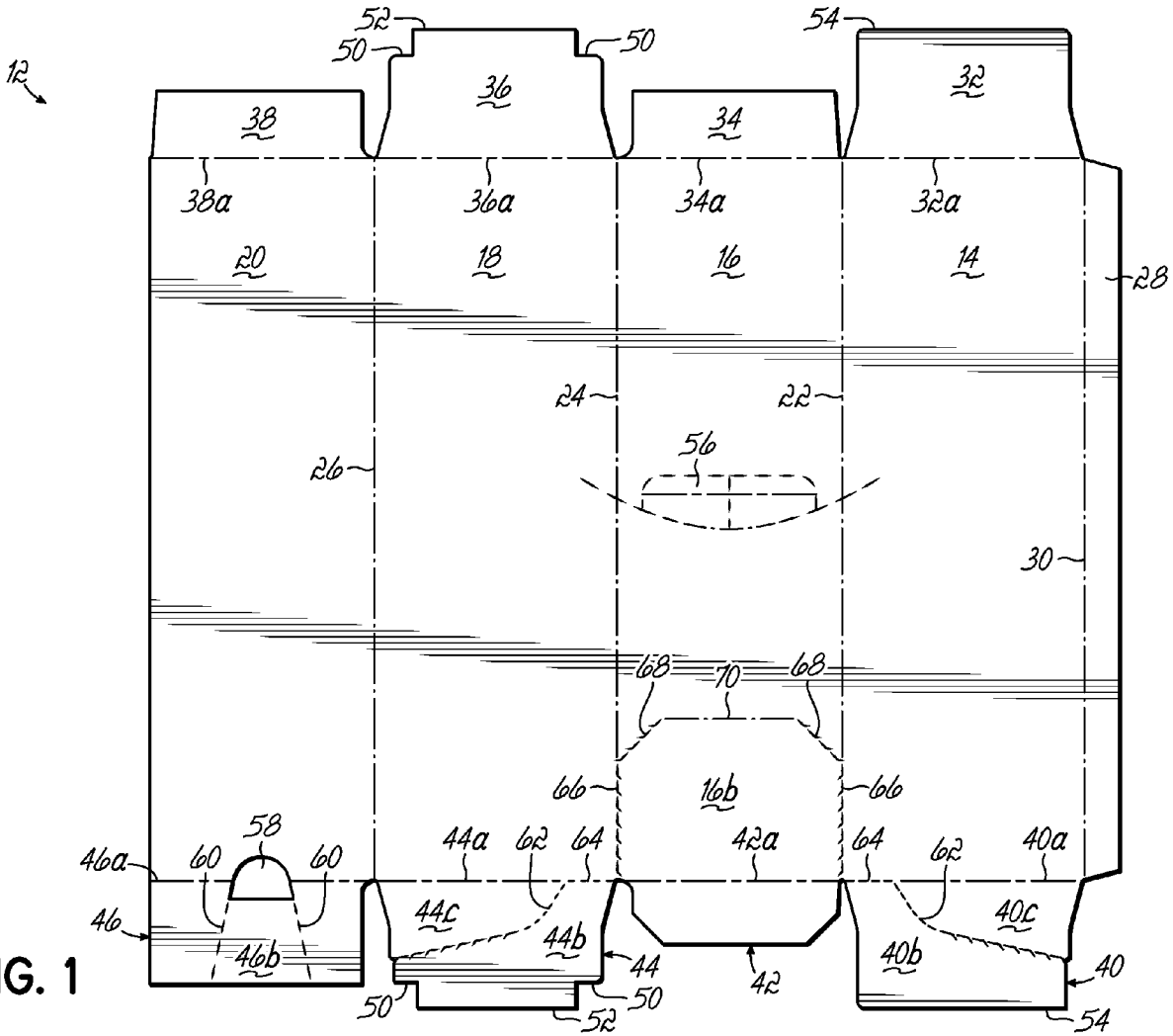
FIG. 1 is a plan view of a blank for forming a carton with a dispenser according to a first preferred embodiment of this invention.
Figure 2:
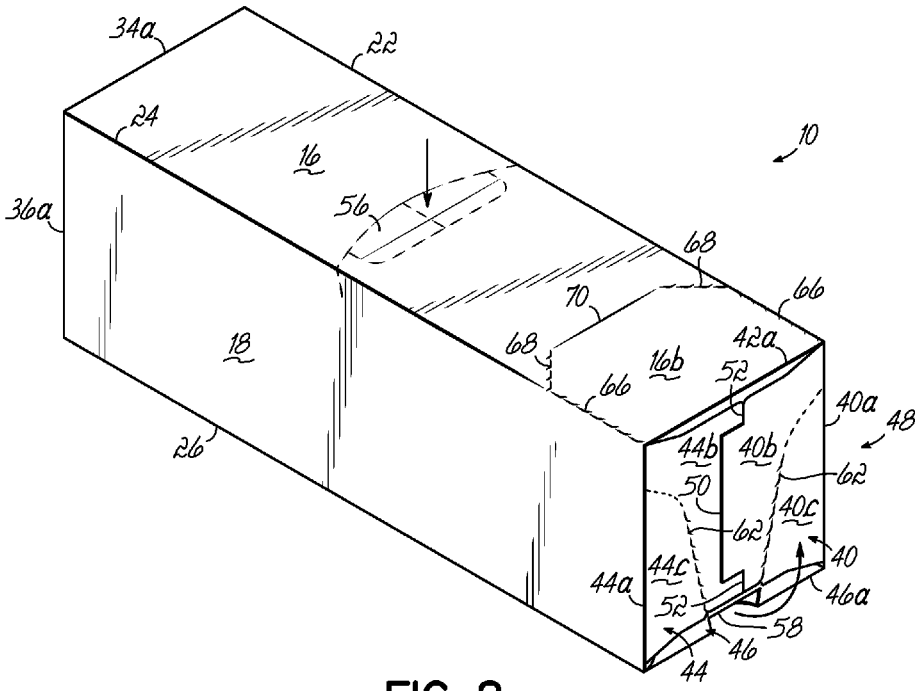
FIG. 2 is a perspective view of a carton constructed from the blank of FIG. 1.
Figure 3:
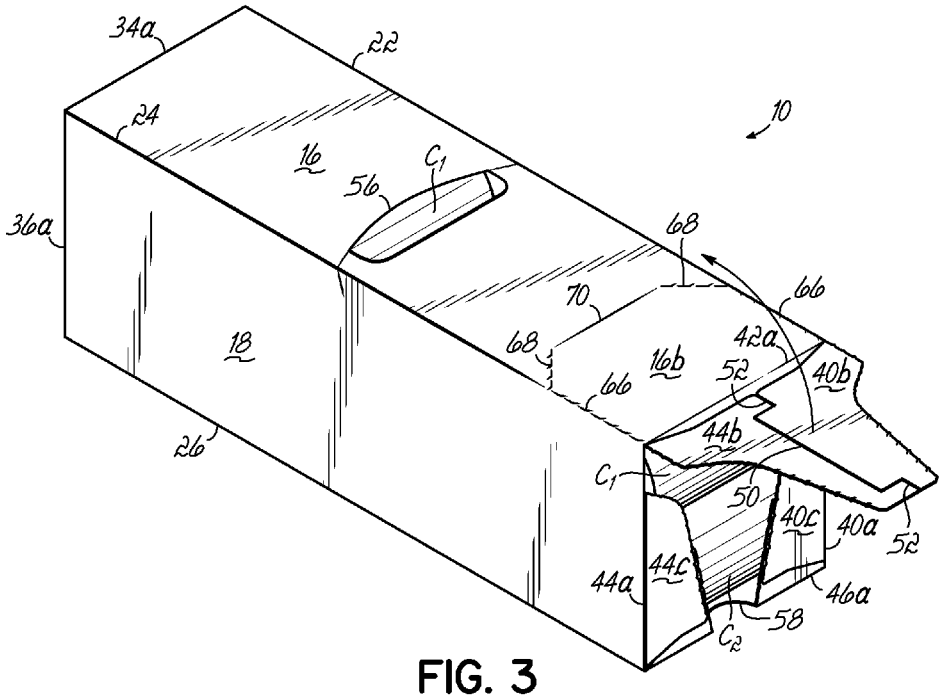
FIGS. 3-5 are perspective sequential views of the carton of FIG. 2 with the dispenser being opened for removal of the articles from the carton.

FIGS. 2 to 5 illustrate a carton 10 having a dispenser in accordance with the first embodiment of this invention. FIG. 1 illustrates a blank 12 from which the carton 10 of FIGS. 2-5 is formed. Cans "C" arranged in a 6×2 array are shown in FIGS. 3-5 as an aid in understanding the invention. More specifically, the cans "C" are arranged in a group consisting of two vertically disposed tiers each including six 12 ounce cans. Cans are generally referred to herein as cans C and shown in the drawings as $C_1$ for cans in the top tier and $C_2$ for cans in the bottom tier. However, this invention is not limited to a 6×2 arrangement and is readily used in a 4×3, other arrangement and/or other size cans. The cans "C" in each tier are disposed on their sides in a side-by-side parallel fashion. As shown particularly in FIGS. 3-5 and 7-10, the tiers of cans C are arranged in a single row with no can in the carton being oriented end to end with another can in the carton, in one aspect of this invention.

Referring to FIG. 1, the blank 12 includes four primary panels for forming the carton walls, i.e., a first side wall panel 14, a top wall panel 16, a second side wall panel 18 and a bottom wall panel 20 foldably connected one to the next along fold lines 22, 24 and 26. A glue flap 28 is foldably connected to side panel 14 along fold line 30. Reference numerals 32, 34, 36, 38, 40, 42, 44 and 46 designate end flaps foldably connected the ends of the panels 14, 16, 18 and 20, respectively. Each end flap 32, 34, 36, 38, 40, 42, 44, 46 is joined to the associated panel 14, 16, 18, 20 by a fold line 32*a*, 34*a*, 36*a*, 38*a*, 40*a*, 42*a*, 44*a*, 46*a*, respectively. The end flaps 32, 34, 36 and 38 arranged along the upper edge (as viewed in FIG. 1) of the blank 12 form a composite end wall (not shown). The end flaps 40, 42, 44 and 46 arranged along the lower edge of FIG. 1 form a composite end wall 58 as shown in FIG. 2.

To form an erected carton from the blank 12, the side wall panels 14, 18 are folded along the fold lines 22, 24. The bottom wall panel 20 is folded along the fold line 26 until it overlaps the glue flap 28 folded inwardly along fold line 30. The overlapping portions of the glue flap 28 and the bottom panel 20 are glued to each other to thereby form a flat tubular carton. The flat tubular carton is then expanded into an open-ended tubular form. After cans C are loaded through one or both of the open ends of the carton 10, the end flaps 32, 34, 36, 38, 40, 42, 44 and 46 are folded to form the respective end walls to thereby close the ends of the carton 10. To form the end walls, the top and bottom end flaps 34, 38, 42 and 46 are folded to their respective positions generally perpendicular to the associated panel wall. The end flaps 36, 44 are then folded to their respective vertical positions to overlap the top and bottom end flaps 34, 42, 38 and 46. End flaps 36, 44 each include a pair of notches 50 so that the terminal edge 52 of each flap 36, 44 is shorter than the corresponding edge 54 on the end flaps 32, 40. Glue is applied to the outside faces of the end flaps 34, 36, 38, 42, 44 and 46. The end flaps 32, 40 are then folded onto the top, bottom, and side end flaps. This causes the side end flaps 32 and 40 to be glued atop the other end flaps.

A handle 56 is also included in the top wall 16. While any appropriate handle or orientation for the handle can be used with the carton 10, preferably handle 56 is constructed according to U.S. Pat. No. 5,106,014, which is hereby incorporated by reference.

A dispenser according to this embodiment of the invention is formed in part by the corresponding end flaps 40, 42, 44, 46 on the dispensing end 48 of the carton 10. A finger hole 58 is formed at the juncture of the bottom panel 20, bottom end flap 46 and a pair of slanted tear lines 60 in the bottom end flap 46 to commence opening the carton 10 and dispenser. The slanted tear lines 60 are useful for a carton containing an arrangement of two tiers of six cans of twelve ounces each; however, the tear lines 60 may be of a different orientation, inclination or configuration for cartons designed to carry other sized cans or arrangements of cans. For example, the tear lines are generally parallel for a carton containing eight ounce cans in a 2×6 configuration. Each side end flap 40, 44 at the dispensing end 48 of the carton 10 includes a tear line 62 which angularly projects from the side edge of the side end flap 40, 44 adjacent to the bottom end flap 46 toward the fold line 40*a*, 44*a* joining the side end flap 40, 44 to the associated side panel 14, 18. A tear line 64 then extends along the fold line 40*a*, 44*a* to the intersection of the top panel 16 and top end flap 42. A tear line 66 then progresses along the juncture between and/or the fold lines 22, 24 joining the top panel 16 and the side panel 14, 18 toward the handle 56 formed in the top panel 16 of the carton 10. The tear lines 66 along the fold lines 22, 24 each terminate at an angular tear line 68 in the top panel 16. Each angular tear line 68 terminates at a cut crease score or fold line 70 which extends laterally across the top panel 16. The tear line(s) forming the dispenser of this embodiment do/does not extend through either side panel 14, 18 or the top panel 16 of the carton 10. The crease line 70 across the top panel 16 joining the corresponding tear lines is a fold line as opposed to an extension of the angular tear lines 68.

Once the carton 10 is erected and filled with cans C, the user opens the dispenser by inserting a finger into the hole 58 in the bottom panel 20 adjacent the bottom end flap 46 and pulling a middle portion 46*b* of the bottom end flap 46 and portions 40*b*, 44*b* of the side end flaps 40, 44 upwardly tearing along the tear lines 60, 62 through the bottom end flap 46 and side end flaps 40, 44. As the user continues to pull upwardly, the dispenser is torn along the tear lines 64 adjacent the side panels 14, 18 and the angular tear lines 68 to the fold line 70 in the top panel 16. In one variation of this embodiment, the top end flap 42 is glued to the center portions 40*b*, 44*b* of the side end flaps 40, 44 so that the entire dispensing structure is folded backwardly onto the top panel 16 and a tongue flap 72 formed from the center portion 46*b* of the bottom end flap 46 and the portions 40*b*, 44*b* are inserted into the handle opening 56 in the top panel 16 to securely and releasably retain the dispenser. The cans C do not fall from the carton 10 once the dispenser is opened because a remaining portion 40*c*, 44*c* of the side end flaps 40, 44 adjacent the side panels 14, 18 remain intact at the end 48 of the carton 10 to form retaining panels 40*c*, 44*c* and hold the cans therein.

If needed, the tongue flap 72 can be removed from the handle opening 56 and folded downwardly toward the dispensing end 48 of the carton 10 while remaining attached to the top panel 16 along the fold line 70. The tongue flap can then be tucked between the corresponding retaining panel portions 44*c*, 40*c* of the side end flaps 44, 40 remaining attached to the respective side panel 18, 14 to releasably close the dispenser for transport of the carton 10 if needed.

In an alternative variation of this embodiment, the glue (not shown) joining the top end flap 42 to the center portions 40*b*, 44*b* of the side end flaps 40, 44 is broken and the user discards the side end flap portions 40*b*, 44*b* and merely tears and folds the end flap 42 and a portion 16*b* of the top panel 16 backwardly to expose the cans C in the carton 10.

Advantageously, the side panels 14, 18 remain intact after the dispenser is opened according to this embodiment of the invention. Additionally, the dispenser need not be entirely removed from the carton 10 which can then be releasably closed once again if needed. Moreover, the handle opening 56 provides a convenient hold for the tongue flap 72 during removal of the cans C.

Referring to FIG. 6, a blank 112 for forming a second embodiment of a carton no according to this invention is shown. The blank 112 includes four primary panels for forming the carton walls, i.e., a first side wall panel 114, a top wall panel 116, a second side wall panel 118 and a pair of bottom wall flaps 120*a*, 120*b* that contribute to form a bottom wall panel 120 foldably connected one to the next along fold lines 122, 124, 126 and 130. Reference numerals 132, 134, 136, 138*a*, 138*b*, 140, 142, 144, 146*a* and 146*b* designate end flaps foldably connected the ends of the primary panels 114, 116, 118, 120*a*, 120*b*. The end flaps 132, 134, 136, 138*a*, 138*b* arranged along the upper edge (as viewed in FIG. 6) of the blank 112 form a composite end wall such as shown at 148 in FIG. 7. The end flaps 140, 142, 144, 146*a* and 146*b* form a composite end wall (not shown) opposite from end wall 148.

To form an erected carton no from the blank 112, the side wall panels 114, 118 are folded along the fold lines 122, 124. The bottom wall flaps 120*a*, 120*b* are folded along the fold lines 126, 130 until the flaps 120*a*, 120*b* overlap one another. The overlapping portions of flaps 120*a*, 120*b* are glued to each other to form the bottom wall 120 and thereby a flat tubular carton no is provided. The flat tubular carton no is then expanded into an open-ended tubular form. After cans C are loaded through one or both of the open ends of the carton 110, the end flaps 132, 134, 136, 138*a*, 138*b*, 140, 142, 144, 146*a* and 146*b* are folded to form the respective end walls to thereby close the ends of the carton 110. To form the end walls, the top and bottom end flaps 134, 138*a*, 138*b*, 142, 146*a*, 146*b* are folded to their respective vertical positions. The end flaps 132, 140 are then folded to their respective vertical positions to overlap the top and bottom end flaps. End flaps 132, 140 each include a pair of notches 150 so that the terminal edge 152 of each flap 132, 140 is shorter than the corresponding edge on the end flaps 136, 144. Glue is applied to the outside faces of the end flaps 132, 134, 138*a*, 138*b*, 140, 142, 146*a* and 146*b*. The end flaps 136, 144 are then folded toward the vertical direction onto the top, bottom, and side end flaps. This causes the side end flaps 136 and 144 to be glued to the top and bottom end flaps and side end flaps.

An erected carton is shown in FIG. 7 wherein a pair of displaceable portions 174, 176 are integrally formed at dispensing end 148 of the carton 110 to be displaceable to form a dispenser. A hand-hole punch-through 178 for grasping the displaceable portion 174 is formed in the top wall 116 by a weakened line of severance 180 and weakened fold lines 182. Together, these lines 180, 182 form the hand-hole punch-through 178 and define a panel 184 on the cusp of the portion 174 adjacent the remainder of the carton 110 that can be grasped to pull up the portion 174 and reveal the forward, uppermost can C1 thru area or opening 186. A weakened severance line or tear line 188 is formed in each of the opposed side walls 114 and 118 and extends from the top wall 116 to the composite end wall 148. In the preferred embodiment illustrated, the tear line lines 188 are of angular configuration. They are formed in generally linear segments 188*a*, 188*b*, 188*c* toward the end wall 148. The tear lines 188 intersect a frangible or otherwise weakened fold line 190 that is formed in the side end flaps 132 and 136 to extend between the side walls 114 and 118 entirely across the end wall 148.

In FIG. 7, the first displaceable portion 174 is substantially removed from the carton 110 at the upper corner region. Alternatively, the portion 174 remains hingedly attached (FIG. 9) to the second displaceable portion 176 of the end wall 148 along the line 192, which may be a tear line or merely scored for bending. With the portion 174 pivoted upward or removed, the dispenser opening 186 is initially revealed. Displaceable portion 174 is defined in part by the severance line 180 and a pair of arcuate-shaped tear lines 194 which extend from the hand-hole punch through 178 to the line 192 adjacent the top wall end flap 134. In one embodiment, lines 194 have a first arcuate portion 194*a* on the top panel 116 and an adjoining, oppositely oriented, and larger arcuate portion 194*b* on the associated side panel 114 or 118. The tear line 194 intersects the associated fold line 122 or 124 as shown in FIGS. 6, 7 and 9.

Once the first displaceable portion 174 is removed from the top panel 116, either completely as in FIG. 7 or hingedly attached along line 192 as in FIG. 9, the upper, forward most can C1 is accessible and removed by the user as shown by arrow A. This is accomplished before the second displaceable portion 176 is removed from the carton 110 to avoid the can C1 from falling uncontrollably onto the user's foot or the like during subsequent removal of the second displaceable portion 176.

After displaceable portion 174 and can C1 are removed as in FIG. 8 or 9, the user pulls tabs 196, formed by arcuate tear lines 194*a*, outwardly from the associated side wall 114, 118 and/or forwardly toward end wall 148. Tabs 196 extend upwardly above the fold lines 122, 124. By pulling tabs 196, the removal of the second displaceable portion 176 begins by tearing along lines 188*a*, 188*b* and 188*c*, consecutively. Tear line 188*a* is bifurcated along tear lines 198*a*, 198*b* around a circular button 200. The button 200 provides for directed and controlled tearing along tear line 188 to avoid errant tearing of the carton 110 or side panels 114, 116. The tear lines 188 may proceed along line 198*a* as in FIG. 8 or line 198*b* as in FIG. 10.

When the displaceable portions 174, 176 are in the opened position or completely detached, the lower portion of the end wall 148 forms a retaining panel 202 that extends between the side walls 174 and 176 and generally along the cylindrical axis of the end most can of the lower tier adjacent the panel 202. The upper edge of the panel 202 is defined by the line 190 that is spaced above the bottom wall 120 (see FIG. 8) at a distance less than the diameter of the cans "C", and preferably no more than a half of the diameter of the cans "C". The panel 202 by itself is capable of inhibiting the cans on the lower tier from inadvertently exiting the carton before intended removal. However, an additional or alternative can stopper may be used. The contents of the carton are easily viewed through the dispenser opening 186.

Because each tear line 188 extends across the adjacent end of the endmost can "C" in the lower tier, the opposite ends of the endmost can "C" are partially exposed as shown in FIGS. 8 and 10 so that a user can easily grasp that can by the opposite ends. The geometry of the tear lines 188 help to increase the exposed areas of the can ends. After the top, end-most can C1 is removed from the upper tier, the remaining cans C in the upper tier will nest in the spaces between the cans of the lower tier. Nesting of cans in this manner is well known in the art and is not illustrated.

A third embodiment of the invention is shown in FIGS. 9 to 10, where like parts have been designated by the same reference numeral and the differences with respect to the embodiment of FIGS. 7-8 are discussed in detail herein above. The primary differences between the embodiment of FIGS. 7-8 and that of FIGS. 9-10 is that the two displaceable portions 174, 176 remain foldably attached to each other and the retaining panel 202. Also, the button 200 remains attached to the associated side wall panel 114, 118.

The various embodiments of this invention serve as useful dispensing cartons that can be placed upon a surface or within a compartment such as a refrigerator or pantry. Modifications may be made in the foregoing without departing from the scope and spirit of the claimed invention. It should be also appreciated that as used herein, directional references such as "top", "bottom", "end", "side", "upper" and "lower" do not limit the respective panels to such orientation, but merely serve to distinguish these panels from one another.

While only one end of the carton 10, no shown herein includes a dispenser, each end of the carton 10, no could include a dispenser according to this invention.

It should be further appreciated that any reference to hinged or foldable connection should not be construed as necessarily referring to a single fold line only. Hinged connections can be formed from one or more of one of the following: a score line, a frangible line, a cut crease line or a fold line, without departing from the scope of invention.

From the above disclosure of the general principles of the present invention and the preceding detailed description of at least one preferred embodiment, those skilled in the art will readily comprehend the various modifications to which this invention is susceptible. Therefore, we desire to be limited only by the scope of the following claims and equivalents thereof.

What is claimed is:

1. A blank for forming a carton sized to contain a plurality of beverage containers in only one row having at least two tiers with a first tier of containers positioned above a second tier of containers in the one row within the carton, the blank comprising:

a first side panel;

a top panel;

a second side panel;

a bottom panel;

a first side exiting end flap extending from a first longitudinal end of the first side panel;

a second side exiting end flap extending from a first longitudinal end of the second side panel, the first and second side exiting end flaps contributing to form an exiting end of the carton;

a top exiting end flap extending from a first longitudinal end of the top panel;

a dispenser pattern in at least the top panel, the first side exiting end flap, and the second side exiting end flap, wherein the dispenser pattern defines a dispenser and comprises:

a first tear line portion in the first side exiting end flap;

a second tear line portion in the second side exiting end flap;

a third tear line portion extending along a juncture between the first side panel and the top panel;

a fourth tear line portion extending along a juncture between the second side panel and the top panel;

wherein at least portions of the third and fourth tear portions are co-linear with fold lines connecting the top panel to the first and second side panels, respectively;

wherein the tear line portions defining the dispenser pattern do not extend in the top exiting end flap; and an opening feature operable for a user to remove the dispenser from the exiting end of the carton formed from the blank, the opening feature being located adjacent to a juncture of the exiting end and the bottom panel of the formed carton such that the user may pull upwardly on the dispenser from the opening feature toward the top panel to gain access to the beverage containers within the carton.

2. The blank of claim 1 wherein when the carton is formed, the dispenser pattern extends the entire width of the exiting end of the carton.

3. The blank of claim 2 wherein the dispenser pattern extends the entire height of the exiting end of the carton.

4. The blank of claim 1 wherein the opening feature further comprises:

a finger hole located at least in part in the bottom panel and in communication with a pair of bottom exiting end tear line portions extending in a bottom exiting end flap which extends from a first longitudinal end of the bottom panel.

5. The blank of claim 1 further comprising:

a bottom end flap extending from a first longitudinal end of the bottom panel, wherein the dispenser pattern extends through the bottom end flap.

6. A blank for forming a carton sized to contain a plurality of beverage containers in only one row having at least two tiers with a first tier of containers positioned above a second tier of containers in the one row within the carton, the blank comprising:

a first side panel;

a top panel;

a second side panel;

a bottom panel;

a first side exiting end flap extending from a first longitudinal end of the first side panel;

a second side exiting end flap extending from a first longitudinal end of the second side panel, the first and second side exiting end flaps contributing to form an exiting end of the carton;

a top exiting end flap extending from a first longitudinal end of the top panel;

a dispenser pattern in at least the top panel, the first side exiting end flap, and the second side exiting end flap, wherein the dispenser pattern defines a dispenser and comprises:

a first tear line portion in the first side exiting end flap;

a second tear line portion in the second side exiting end flap;

a third tear line portion extending along a juncture between the first side panel and the top panel;

a fourth tear line portion extending along a juncture between the second side panel and the top panel;

wherein the tear line portions defining the dispenser pattern do not extend in the top exiting end flap;

wherein the first and third tear line portions are contiguous and the second and fourth tear line portions are contiguous.

7. The blank of claim 6 wherein the dispenser pattern extends the entire height of the exiting end of the carton.

8. The blank of claim 6 further comprising:

a bottom end flap extending from a first longitudinal end of the bottom panel, wherein the dispenser pattern extends through the bottom end flap.

9. The blank of claim 6 wherein when the carton is formed, the dispenser pattern extends the entire width of the exiting end of the carton.

10. A package comprising:

a plurality of beverage containers arranged in only one row having at least two tiers including a top tier and a bottom tier;

a carton enclosing the beverage containers, the carton further comprising:

a first side panel;

a top panel;

a second side panel;

a bottom panel;

a first side exiting end flap extending from a first longitudinal end of the first side panel;

a second side exiting end flap extending from a first longitudinal end of the second side panel, the first and second side exiting end flaps contributing to form an exiting end of the carton;

a top exiting end flap extending from a first longitudinal end of the top panel;

a dispenser pattern in at least the top panel, the first side exiting end flap, and the second side exiting end flap, wherein the dispenser pattern defines a dispenser and comprises:

a first tear line portion in the first side exiting end flap;

a second tear line portion in the second side exiting end flap; and a third tear line portion extending along a juncture between the first side panel and the top panel;

a fourth tear line portion extending along a juncture between the second side panel and the top panel;

wherein the first and third tear line portions are contiguous and the second and fourth tear line portions are contiguous;

wherein the tear line portions defining the dispenser pattern do not extend in the top exiting end flap;

an opening feature operable for a user to remove the dispenser from the exiting end of the carton, the opening feature being located adjacent to a juncture of the exiting end and the bottom panel such that the user may pull upwardly on the dispenser from the opening feature toward the top panel to gain access to the beverage containers within the carton.

11. The package of claim 10 further comprising:

a bottom end flap extending from a first longitudinal end of the bottom panel, wherein the dispenser pattern extends through the bottom end flap.

12. The package of claim 10 further comprising:

at least one retaining panel in the exiting end adjacent the dispenser pattern to retain the remaining beverage containers in each of the top and bottom tiers within the carton.

13. The package of claim 10 wherein the dispenser remains attached to the top panel after being opened for reclosure of the carton and a remainder of the carton remains structurally intact to contain a remainder of the beverage containers in the carton until subsequent removal from the carton.

14. The package of claim 10 wherein at least portions of the third and fourth tear portions are co-linear with fold lines connecting the top panel to the first and second side panels, respectively.

15. The package of claim 10 wherein the dispenser pattern extends the entire width of the exiting end of the carton.

16. The package of claim 15 wherein the dispenser pattern extends the entire height of the exiting end of the carton.

17. The package of claim 10 wherein the package contains only two tiers of containers.

18. The package of claim 10 wherein none of the containers are arranged in an end to end orientation with another one of the containers.

* * * * *

UNITED STATES PATENT AND TRADEMARK OFFICE

CERTIFICATE OF CORRECTION

PATENT NO. : 8,646,654 B2
APPLICATION NO. : 13/399359
DATED : February 11, 2014
INVENTOR(S) : Charles A. Miller It is certified that error appears in the above-identified patent and that said Letters Patent is hereby corrected as shown below:

In the Specification:

At column 6, line 47, "a carton no according to" should read --a carton 110 according to--

At column 6, line 61, "carton no from" should read --carton 110 from--

At column 6, line 67, "carton no is provided" should read --carton 110 is provided--

At column 6, line 67, "carton no is then" should read --carton 110 is then--

At column 8, line 52, "carton 10, no shown" should read --carton 10, 110 shown--

At column 8, line 53, "carton 10, no could" should read --carton 10, 110 could--

Signed and Sealed this
Thirteenth Day of May, 2014

Michelle K. Lee

Michelle K. Lee
*Deputy Director of the United States Patent and Trademark Office*